United States Patent [19]

Farr

[11] 4,129,964

[45] Dec. 19, 1978

[54] DOUBLE WINDOW HAVING IMPROVED WEATHER SEALED VENTILATION

[76] Inventor: Lee E. Farr, 1940 Broadway #5, San Francisco, Calif. 94109

[21] Appl. No.: 854,958

[22] Filed: Nov. 25, 1977

[51] Int. Cl.[2] ..... E05B 65/04

[52] U.S. Cl. ..... 49/67; 49/61

[58] Field of Search ..... 49/67, 61, 50, 56, 57; 52/202

[56] References Cited

U.S. PATENT DOCUMENTS

| | | | |
|---|---|---|---|
| 1,108,613 | 8/1914 | Parker | 49/61 X |
| 1,864,790 | 6/1932 | Barker | 49/67X |

FOREIGN PATENT DOCUMENTS

| | | | |
|---|---|---|---|
| 709579 | 5/1954 | United Kingdom | 49/61 |

*Primary Examiner*—Philip C. Kannan

*Attorney, Agent, or Firm*—Townsend and Townsend

[57] ABSTRACT

This invention relates to a shield for windows. More particularly, a confronting double frame window is disclosed which provides improved ventilation and weather shielding for light windows especially useful in mild climates. Conventional single pane glass windows used in such climates when in their closed position, rely on a circuitous path at their weather surface between relatively moving parts for excluding ambient weather, especially wind-driven rain. Such conventional windows include sliding windows with their bottoms riding in a U-section channel and louvered windows having parallel and relatively moving panes of glass which move into and out of juxtaposition with each other in providing ventilation. These types of conventional windows are provided with a second overlying continuous and confronting frame mounted glass panel. This glass panel is held, typically within a frame which is spatially mounted at its periphery, to overlie the border of the conventional window. Ventilation access into the building through the window and around the confronting pane of glass is provided by a gap in the critical range of 1.5 to 2.25 inches. Surprisingly, ventilation provided by such a window remains essentially constant in all weather conditions, including calm airs and heavy winds. Moreover, during confronting storms common to many climates, mositure penetration due to syphoning of the circuitous path into the interior of window-guarded dwellings is avoided.

7 Claims, 4 Drawing Figures

DOUBLE WINDOW HAVING IMPROVED WEATHER SEALED VENTILATION

STATEMENT OF THE PROBLEM

Conventional windows utilized in mild as well as tropical and subtropical climates usually are of the sliding window design or the louvered window design. In the sliding window design, the bottom edge of the window sash typically fits within the U-shaped channel. The sash itself rides on rollers which typically ride a rail intermediate the U-shaped channel. During weather conditions such as wind-driven rain, the U-shaped channel typically fills with water, whereupon either the windloading from the outside or a weather-syphoning effect on the inside of the dwelling draws water through the circuitous path provided by the U-shaped channel into the interior sill of the dwelling. It is a common experience that water penetrates interior of the dwelling and damages the inside dwelling surfaces including wall surfaces immediately below such windows, and floors and rugs.

Conventional louvered windows present a similar problem. Typically, they rely on overlapping pieces of glass that provide a circuitous path to prevent the penetration of wind-driven rain and the like. Again, water penetrating the interface between the overlapping pieces of glass is drawn to the interior of the dwelling responsive to a pressure differential between the exterior and interior of the dwelling.

If the structure to which such conventional windows are mounted is inhabited, the windows are commonly adjusted in their opening to complement the ambient weather conditions. On a hot day, they are open full. On cold windy days, they are typically closed. When the occupants of such dwellings are away during anticipated changing weather conditions, such windows must be fully closed. If they are not closed, a change in the ambient weather conditions allows a gross penetration of moisture. More importantly, even when closed such windows allow the penetration of moisture. This typically occurs due to a syphoning effect. In the case of sliding windows, the syphoning is along the bottom and side edges of a U-shaped channel; in the case of louvered windows, it is between overlapped pieces of glass.

SUMMARY OF THE PRIOR ART

Overlapping glass shields for windows are known. Typically, they are provided in pivotal combination with conventional windows. No utilization of a constantly maintained gap at the window periphery for both constant and uninterrupted ventilation in all weather conditions and improved weather shielding has heretofore been disclosed.

SUMMARY OF THE INVENTION

This invention relates to a shield for windows. More particularly, a confronting double frame window is disclosed which provides improved ventilation and weather shielding for light windows useful in mild climates. Conventional windows of the sliding and louvered variety are provided with a second overlying continuous and confronting frame mounted glass panel. This glass panel is held, typically within a frame which is spatially mounted at its periphery, to overlie the border of the conventional window. Ventilation access into the building through the window and around the confronting pane of glass is provided by a gap in the critical range of 1.5 to 2.25 inches. Surprisingly, ventilation provided by such a window remains essentially constant in all weather conditions, including calm airs and heavy winds. Moreover, during confronting storms common to many climates, moisture penetration due to syphoning of the circuitous path into the interior of window-guarded dwellings is avoided.

OTHER OBJECTS AND ADVANTAGES OF THE INVENTION

An object of this invention is to disclose a protective shield window adaptable for windows of the type relying on circuitous paths to prevent the penetration of weather. In accordance with this invention, a critical gap is disclosed around the periphery of a confronting and overlying glass pane. This gap is in the critical range of 1.5 to 2.25 inches and can be in the preferred range of 1.75 to 2 inches.

An advantage of the disclosed storm window is that it provides constant ventilation for substantially all weather conditions. Where mild winds confront the structure, normal high volume ventilation occurs. Where high winds confront the structure, ventilation remains substantially the same; adjustment of the underlying conventional window to a closed position is not required.

A second advantage of this invention is that weather syphon leaks are prevented. Water penetration to the circuitous interface of the window is typically prevented.

A third advantage of this invention is that improved ventilation security is present. The underlying conventional window may be left opened in a ventilation position even when oncoming weather fronts are anticipated. Ventilation provided to the structure remains constant even though the weather conditions change and confronting wind-driven rain is presented to the structure.

A fourth advantage of this invention is that improved physical security is provided. If the confronting glass panel is not easily removable by unauthorized personnel, as would be the case if it were locked in place, the underlying conventional window may be left open to provide ventilation, even when the structure is unoccupied. If the underlying window is closed, the confronting glass panel continues to provide additional protection against unauthorized access.

A fifth advantage is that the invention permits flexibility in the choice of material for the confronting frame. Thus the unit is readily integrated into the architecture of the structure to which it is attached. Moreover, the aesthetic appearance of the structure is improved due to the fact that open windows are less apparent, being covered by the expanse of the confronting pane.

Other objects, features and advantages of this invention will become more apparent after referring to the following specification and attached drawings in which:

FIG. 1*a* is a perspective view of a window of the sliding pane variety having the confronting weather frame of this invention mounted thereto;

FIG. 1*b* illustrates a hook and eye arrangement for the allowing outward movement of the confronting weather frame of this invention;

FIG. 2 is an illustration of the window without the confronting of this pane illustrating the prior art leakage through syphoning which occurs at such windows; and, FIG. 3 illustrates the critical gap utilized with the confronting weather frame of this invention.

DETAILED DESCRIPTION OF THE DRAWINGS

Figure 1A:
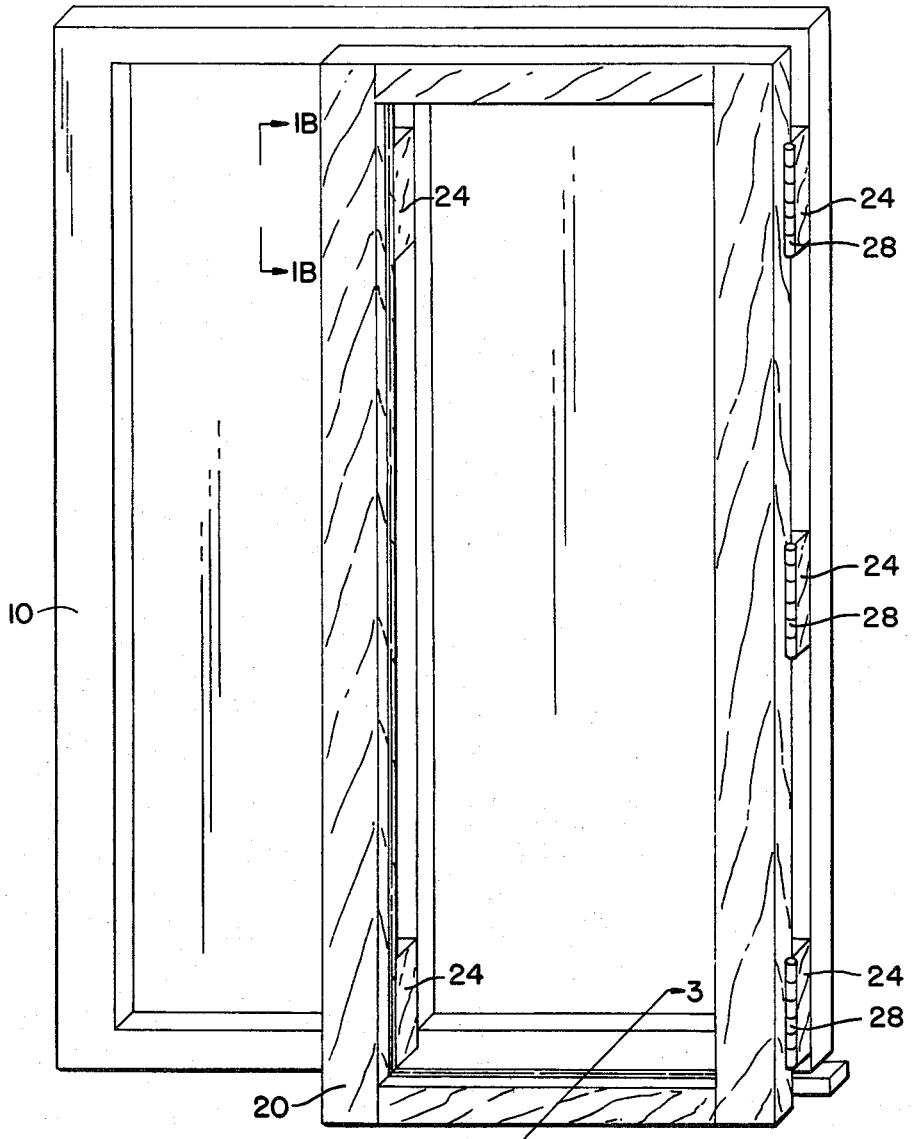

FIG. 1*a* illustrates the mounting of the confronting frame 20 of this invention onto the frame 10 of a conventional window. The conventional window in the particular embodiment of the invention disclosed herein is of the sliding pane variety, the outer frame 10 of which is peripheral to two sections in side by side relationship. The right-hand section is capable of sliding to the left so that it overlaps the left-hand section which is immovable. Since only the right-hand section of the window is capable of being opened, the confronting frame 20 of this invention is seen to be mounted so as to overlie only said right-hand section. For the embodiment not illustrated here in which the conventional window is of the louvered variety, or is otherwise capable of being completely opened, the confronting frame is mounted so as to completely overlie the frame of the conventional window.

The confronting frame 20 is mounted at several points along its edge so that it lies in a plane parallel to that in which the conventional window frame 10 lies. The important and not yet understood constant ventilation effect is achieved by ensuring that a gap in the critical range of 1.5 to 2.25 inches is maintained between the confronting frame 20 and the conventional window frame 10. This critical gap is maintained by spacer blocks 24 that are shown in this embodiment as being rigidly attached to or integral with the frame of the conventional window. In an alternate embodiment, the spacer blocks 24 could be rigidly attached to or integral with the confronting frame of this invention.

Figure 1B:
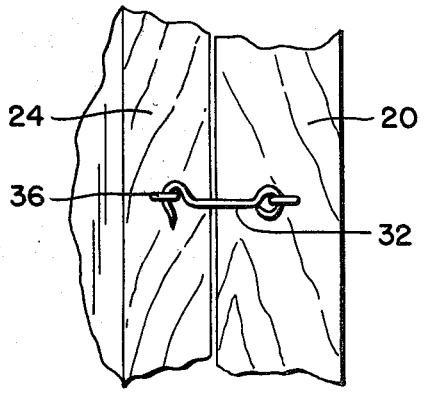

In order to facilitate maintenance such as cleaning, or replacement of broken panes, the confronting frame is mounted in a removable or semi-removable manner. In this embodiment the confronting frame 20 is mounted to the spacer blocks that are along one side by hinges 28 so that it may be swung outward and away from the window frame 10. Closure at the other side may be effected by various means well known in the art, one such method being indicated in FIG. 1*b*. A hook 32 is mounted on the confronting frame 20 so as to cooperate with an eye 36 mounted on spacer block 24. Alternately, a locking mechanism that requires a key to unlock it can be installed.

Figure 2:
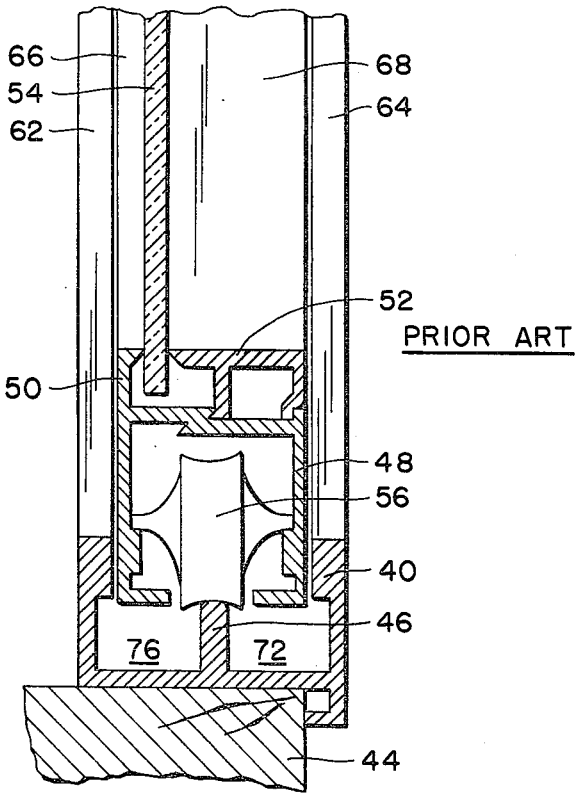

FIG. 2 is a cross section of the lower portion of the conventional sliding window. This may be either vertical or horizontal in its motion. For convenience, only the horizontal will be described. The region to the right of the window is outside the house; that to the left, inside. An upwardly concave channel 40 which is the lower horizontal member of the window frame 10 is rigidly attached to the wall 44 of the house. The concavity of the channel 40 is bisected by an upwardly protruding rail 46 which runs along the center of the channel. The structure designated by numeral 48 is the lower horizontal member of the sash frame of the sliding window. A flange 50 on sash member 48 cooperates with a retaining member 52 so as to hold the pane of glass 54 rigidly within the sash frame, the entire sash being free to slide back and forth. Roller 56 is one of a series of such rollers mounted within sash member 48 along its length, and is designated to roll along the top of rail 46 so as to provide a sliding window that is relatively friction free.

The right-hand upright member of window frame 10 (referring to FIG. 2) has a cross section similar to that of channel 40, except that there is no central rail like 46. The projection of the flanges of said right-hand upright members into the plane of the cross section are designated 62 and 64. Likewise, the right-hand upright member of the sash frame is projected into the plane of the cross section and is represented by numerals 66 and 68.

One difficulty is immediately apparent. In order to have a freely sliding window, it is necessary that the clearance between channel 40 and sash member 48 be relatively loose. Therefore, it is easy for the water on the outside to find its way between the sash frame 48 and the channel 40 of the window frame 10 so that region 72 within the channel becomes filled with water. When the level of water reaches the top of rail 46, region 76 begins to fill with water. At this point, water can easily find its way into the house, either as a result of windloading from the outside, or weather syphoning from the inside.

Figure 3:
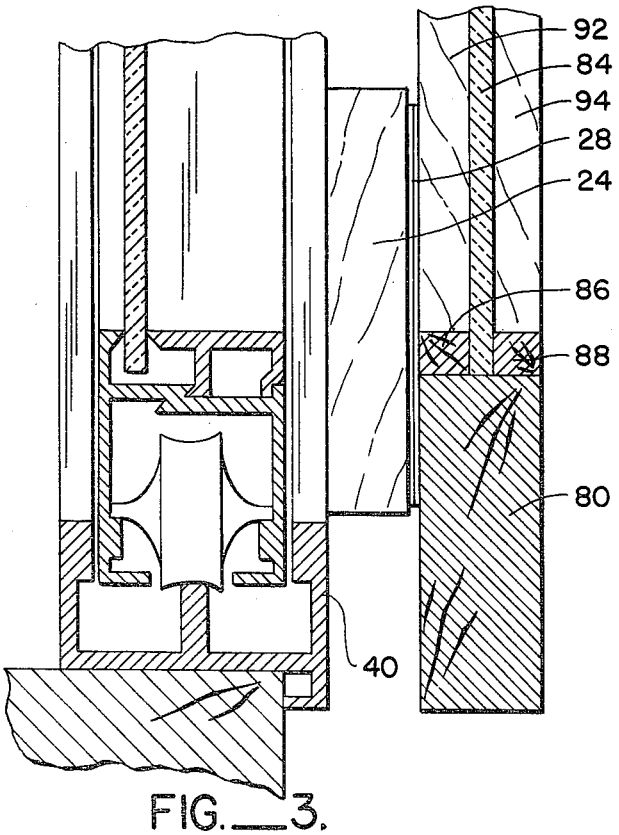

FIG. 3 shows a cross section of a sliding window with the confronting frame of this invention in place. The cross section of the sliding window is identical to that of FIG. 2. Confronting frame 20 (referring to FIG. 3), the lower horizontal member of which is designated 80, surrounds a pane of glass 84 which is retained in fixed relationship by retaining members 86 and 88 extending along the entire periphery of the pane. The proper distance between the confronting frame and the conventional window frame 10 is maintained by spacer blocks 24, the bottom right-hand one of which (again referring to FIG. 3) is shown with its associated hinge 28 projected into the plane of the cross section. The projection of the right-hand vertical member of the confronting frame is shown as 92 and 94. Once the glass panel is place maintained within the critical gap of 1.5 to 2.25 inches at least around the periphery of the sliding portion of the window, it has been found that the improved ventilation characteristics described herein result. No matter how the opening of the underlying conventional house window is varied, through house ventilation remains substantially unchanged. Thus windows can be maintained despite variations of weather during occupant absence.

The preferred embodiment here has illustrated the use of this invention with a sliding window sliding in the horizontal direction within a U-shaped channel. It should be understood that this invention could likewise be used with vertically moving windows, provided such windows have a conventional sill with the problems of moisture penetration described herein. It should be understood that special windows such as those dropping into pockets and the like are not included in the combination of this invention.

I claim:

1. A double window comprising in combination a conventional window at least a portion of which is capable of being opened to admit air; a confronting pane of transparent material overlying said portion of said conventional window that is capable of being opened; and, means for maintaining said confronting pane in a plane that is parallel to the plane in which said conventional window lies and exterior the structure of which said conventional window is a part, such that a gap between said conventional window and said confronting pane exists at the entire periphery of said confronting pane, said gap being in the range between 1.5 and 2.25 inches.

2. The invention of claim 1 and wherein said gap is maintained in the range between 1.75 and 2.0 inches.

3. The invention of claim 1 and wherein said confronting pane is hinged along one edge and fastened removably at the opposite edge.

4. The invention of claim 1 and wherein said means for maintaining said confronting pane consists of spacer blocks for substantially the same thickness as the desired gap.

5. The invention of claim 4 and wherein said spacer blocks are fastened to or integral with said confronting pane.

6. The invention of claim 4 and wherein said spacer blocks are fastened to or integral with the frame of said conventional window.

7. In a window having a pane of glass movable between a first air blocking disposition and a second open position, said pane of glass movable at the bottom portion thereof along a U-shaped channel, said U-shaped channel providing a circuitous path for the penetration of weather from the exterior of said window to the interior of said window, the improvement to said window comprising: a confronting pane of transparent material overlying said portion of said conventional window that is capable of being open; a frame for holding said confronting pane of transparent material; and, means for maintaining said frame and confronting pane in a plane that is parallel to the plane of said conventional window such that the gap between said frame and said conventional window exists at the periphery of said confronting frame, said gap being in the range of 1.5 to 2.25 inches.

* * * * *